US010891897B2

(12) United States Patent
Xu et al.

(10) Patent No.: US 10,891,897 B2
(45) Date of Patent: Jan. 12, 2021

(54) METHOD AND SYSTEM FOR ESTIMATING AND COMPENSATING AGING OF LIGHT EMITTING ELEMENTS IN DISPLAY PANEL

(71) Applicant: SHENZHEN YUNYINGGU TECHNOLOGY CO., LTD., Shenzhen (CN)

(72) Inventors: Haining Xu, Shanghai (CN); Yaoming Lin, Shanghai (CN); Shike Wu, Shanghai (CN); Yajun Cao, Shanghai (CN); Yan Lin, Shanghai (CN); Zhenqiang Ma, Shanghai (CN)

(73) Assignee: SHENZHEN YUNYINGGU TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/709,347

(22) Filed: Dec. 10, 2019

(65) Prior Publication Data

US 2020/0357336 A1 Nov. 12, 2020

Related U.S. Application Data

(63) Continuation of application No. PCT/CN2019/086184, filed on May 9, 2019.

(51) Int. Cl.
*G09G 3/3233* (2016.01)

(52) U.S. Cl.
CPC ... *G09G 3/3233* (2013.01); *G09G 2320/0242* (2013.01); *G09G 2320/0257* (2013.01); *G09G 2320/045* (2013.01); *G09G 2330/12* (2013.01)

(58) Field of Classification Search
CPC ..... G09G 2320/04
See application file for complete search history.

(56) References Cited

U.S. PATENT DOCUMENTS

2017/0213493 A1* 7/2017 Han ..... G09G 3/3208
2020/0349884 A1* 11/2020 Lai ..... G09G 3/3208

* cited by examiner

*Primary Examiner* — Sepehr Azari
(74) *Attorney, Agent, or Firm* — Bayes PLLC

(57) ABSTRACT

The present disclosure provides methods and systems for estimating and compensating the aging of light emitting elements in a display panel. In one example, a method for compensating aging of light emitting elements in a display panel is disclosed. A luminance target is determined based on historical luminance losses of a plurality of light emitting elements in the display panel. An adjusted luminance loss of one of the plurality of light emitting elements is determined based on a current and a luminance loss of the light emitting element. A compensation factor of the light emitting element is determined based on the adjusted luminance loss of the light emitting element and the luminance target. A compensated current is provided to the light emitting element based on the current and the compensation factor of the light emitting element.

18 Claims, 11 Drawing Sheets

METHOD AND SYSTEM FOR ESTIMATING AND COMPENSATING AGING OF LIGHT EMITTING ELEMENTS IN DISPLAY PANEL

CROSS REFERENCE TO RELATED APPLICATION

This application is continuation of International Application No. PCT/CN2019/086184, filed on May 9, 2019, entitled "METHOD AND SYSTEM FOR ESTIMATING AND COMPENSATING AGING OF LIGHT EMITTING ELEMENTS IN DISPLAY PANEL," which is hereby incorporated by reference in its entirety.

BACKGROUND

The disclosure relates generally to display technologies, and more particularly, to methods and systems for estimating and compensating aging of light emitting elements in a display panel.

Organic light emitting diode (OLED), a self-light-emitting device, is emerging as a next-generation display because it does not require a backlight and has high contrast, wide viewing angle, fast response, and low power consumption. For example, an active-array organic light emitting diode (AMOLED) display includes an active array of OLEDs generating light (luminescence) upon electrical activation that has been deposited or integrated onto a thin film transistor (TFT) array, which functions as a series of switches to control the current flowing to each individual light emitting element (subpixel).

However, due to the limitations of available materials and processes for making the OLED displays, OLED displays suffer from an issue called "screen burn-in." The wide variation in luminance degradation or aging with OLED displays can cause noticeable color drift and/or ghost images over time. Some existing approaches have been used to remedy the burn-in issue by estimating and compensating the aging of the OLEDs. For example, a dedicated circuit for measuring the luminance degradation of each OLED can be added for each OLED, which, however, increases the cost of the displays and reduces the aperture ratio. Some statistic methods estimate the luminance loss based solely on the usage time of the OLEDs, which lack accuracy. As to aging compensation, known approaches simply increase the grayscales of the OLEDs based on the estimated aging, which sometimes can cause over-exposure on the screen and/or speed-up the aging.

SUMMARY

The disclosure relates generally to display technologies, and more particularly, to methods and systems for estimating and compensating aging of light emitting elements in a display panel.

In one example, a method for estimating aging of light emitting elements in a display panel is disclosed. A current, a position, and a temperature associated with a light emitting element in the display panel are determined based on display data provided to the display panel at a time interval. A current aging weight of the light emitting element is determined based on the current and a current-aging relationship measured at a standard temperature. A temperature aging weight of the light emitting element is determined based on the temperature and a temperature-aging relationship measured at a standard current. A position aging weight of the light emitting element is determined based on the position.

An aging rate of the light emitting element is determined based on the current aging weight, the temperature aging weight, and the position aging weight. An aging time of the light emitting element is determined based on the aging rate of the light emitting element and the time interval. A luminance loss of the light emitting element is determined based on the aging time and a luminance loss-aging time relationship measured at the standard temperature and the standard current.

In another example, a system for estimating aging of light emitting elements in a display panel includes a display panel including a plurality of light emitting elements and a control logic operatively coupled to the display panel. The control logic is configured to determine a current, a position, and a temperature associated with one of the light emitting elements in the display panel based on display data provided to the display panel at a time interval. The control logic is also configured to determine a current aging weight of the light emitting element based on the current and a current-aging relationship measured at a standard temperature. The control logic is further configured to determine a temperature aging weight of the light emitting element based on the temperature and a temperature-aging relationship measured at a standard current. The control logic is further configured to determine a position aging weight of the light emitting element based on the position. The control logic is further configured to determine an aging rate of the light emitting element based on the current aging weight, the temperature aging weight, and the position aging weight. The control logic is further configured to determine an aging time of the light emitting element based on the aging rate of the light emitting element and the time interval. The control logic is further configured to determine a luminance loss of the light emitting element based on the aging time and a luminance loss-aging time relationship measured at the standard temperature and the standard current.

In still another example, a method for compensating aging of light emitting elements in a display panel is disclosed. A luminance target is determined based on historical luminance losses of a plurality of light emitting elements in the display panel. An adjusted luminance loss of one of the plurality of light emitting elements is determined based on a current and a luminance loss of the light emitting element. A compensation factor of the light emitting element is determined based on the adjusted luminance loss of the light emitting element and the luminance target. A compensated current is provided to the light emitting element based on the current and the compensation factor of the light emitting element.

In yet another example, a system for compensating aging of light emitting elements in a display panel includes a display panel including a plurality of light emitting elements and a control logic operatively coupled to the display panel. The control logic is configured to determine a luminance target based on historical luminance losses of the plurality of light emitting elements in the display panel. The control logic is also configured to determine an adjusted luminance loss of one of the plurality of light emitting elements based on a current and a luminance loss of the light emitting element. The control logic is further configured to determine a compensation factor of the light emitting element based on the adjusted luminance loss of the light emitting element and the luminance target. The control logic is further configured to control the output of a compensated current to the light emitting element based on the current and the compensation factor of the light emitting element.

In yet another example, a method for dynamically compensating aging of light emitting elements in a display panel is disclosed. A current, a position, and a temperature associated with a light emitting element in the display panel are determined based on display data provided to the display panel at a time interval. An aging rate of the light emitting element is determined based on the current, the temperature, and the position associated with the light emitting element. An aging time of the light emitting element is determined based on the aging rate of the light emitting element and the time interval. A luminance loss of the light emitting element is determined based on the aging time and a luminance loss-aging time relationship measured at a standard temperature and a standard current. A luminance target is determined based on historical luminance losses of a plurality of light emitting elements in the display panel. An adjusted luminance loss of the light emitting element is determined based on the current and the luminance loss of the light emitting element. A compensation factor of the light emitting element is determined based on the adjusted luminance loss of the light emitting element and the luminance target. A compensated current is provided to the light emitting element based on the current and the compensation factor of the light emitting element.

In yet another example, a system for dynamically compensating aging of light emitting elements in a display panel includes a display panel including a plurality of light emitting elements and a control logic operatively coupled to the display panel. The control logic is configured to determine a current, a position, and a temperature associated with one of the light emitting elements in the display panel based on display data provided to the display panel at a time interval. The control logic is also configured to determine an aging rate of the light emitting element based on the current, the temperature, and the position. The control logic is further configured to determine an aging time of the light emitting element based on the aging rate of the light emitting element and the time interval. The control logic is further configured to determine a luminance loss of the light emitting element based on the aging time and a luminance loss-aging time relationship measured at a standard temperature and a standard current. The control logic is further configured to determine a luminance target based on historical luminance losses of the plurality of light emitting elements in the display panel. The control logic is further configured to determine an adjusted luminance loss of the light emitting element based on the current and the luminance loss of the light emitting element. The control logic is further configured to determine a compensation factor of the light emitting element based on the adjusted luminance loss of the light emitting element and the luminance target. The control logic is further configured to control the output of a compensated current to the light emitting element based on the current and the compensation factor of the light emitting element.

BRIEF DESCRIPTION OF THE DRAWINGS

The embodiments will be more readily understood in view of the following description when accompanied by the below figures and wherein like reference numerals represent like elements, wherein.

DETAILED DESCRIPTION

Figure 1:
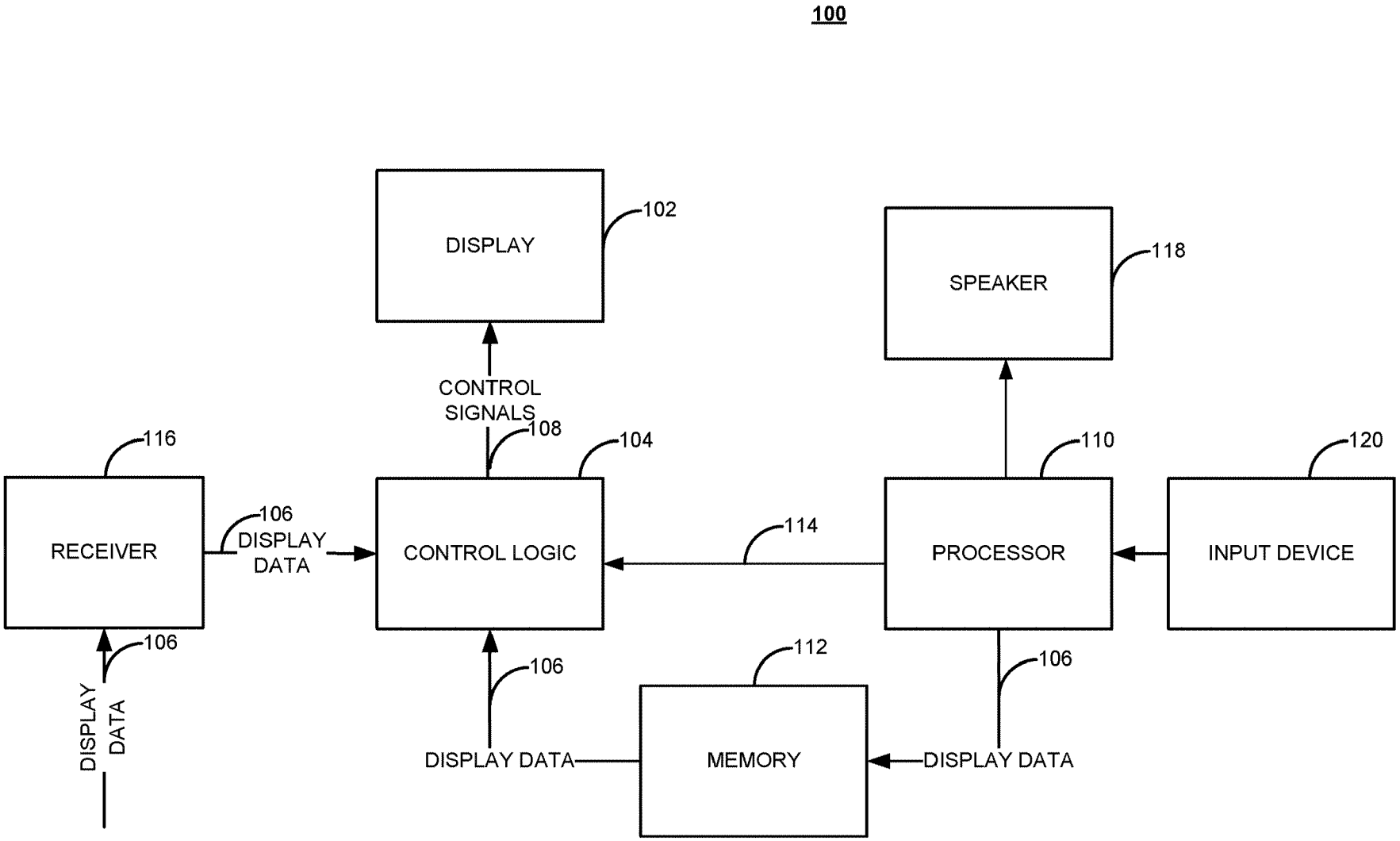
FIG. 1 is a block diagram illustrating an apparatus including a display and control logic in accordance with an embodiment.

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

As will be disclosed in detail below, among other novel features, the methods and systems disclosed herein can effectively and efficiently mitigate the luminance degradation of light emitting elements (e.g., OLEDs) in a display panel without modifying the structure of the display panel. The remedy of the luminance degradation can be achieved by a multi-factor aging estimation scheme combined with a dynamic aging compensation scheme. The estimation of the aging of light emitting elements can take into consideration of impacts from multiple factors, such as the current (gray-scale), temperature, and position associated with each light emitting element, thereby increasing the accuracy and adjustability of the estimation. In some embodiments, various aging rates at different currents and/or temperatures are mapped to the same standard current and temperature for estimation, such that the individual impact of current or temperature on the aging can be separately determined, which improves the efficiency of the estimation.

The compensation of the aging of light emitting elements can map different luminance losses of different light emitting elements in the display panel into the same luminance target plane for compensation to avoid color drift and/or ghost images. Various ways of setting the luminance target based on the historical luminance loss data can be used to prevent over-exposure and the speed-up of aging or even to slow down the aging. In some embodiments, the luminance target is dynamically adjusted depending on different usage stages of the display panel to further improve user experience and extend the lifespan of the display panel.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 illustrates an apparatus 100 including a display 102 and control logic 104. Apparatus 100 may be any suitable device, for example, a virtual reality/augmented reality (VR/AR) device (e.g., VR headset, etc.), handheld device (e.g., dumb or smartphone, tablet, etc.), wearable device (e.g., eyeglasses, wristwatch, etc.), automobile control station, gaming console, television set, laptop computer, desktop computer, netbook computer, media center, set-top box, global positioning system (GPS), electronic billboard, electronic sign, printer, or any other suitable device. In this example, display 102 is operatively coupled to control logic 104 and is part of apparatus 100, such as but not limited to, a head-mounted display, computer monitor, television screen, dashboard, electronic billboard, or electronic sign. Display 102 may be an OLED display, liquid crystal display (LCD), E-ink display, electroluminescent display (ELD), billboard display with LED or incandescent lamps, or any other suitable type of display.

Control logic 104 may be any suitable hardware, software, firmware, or combination thereof, configured to receive display data 106 and render the received display data 106 into control signal 108 for writing of data to the subpixels and directing operations of display 102. For example, subpixel rendering algorithms for various subpixel arrangements may be part of control logic 104 or implemented by control logic 104. In some embodiments, control logic 104 in one example may include a timing controller (TCON) and a clock generator (not shown). As described below in detail with respect to FIGS. 4-11, control logic 104 may include an estimation module 402 for aging estimation and a compensation module 404 for aging compensation, which may be part of the TCON. Control logic 104 may include any other suitable components, such as an encoder, a decoder, one or more processors, controllers, and storage devices. Control logic 104 may be implemented as a stand-alone integrated circuit (IC) chip, such as an application-specific integrated circuit (ASIC) or a field-programmable gate array (FPGA). Apparatus 100 may also include any other suitable component such as, but not limited to, a speaker 118 and an input device 120, e.g., a mouse, keyboard, remote controller, handwriting device, camera, microphone, scanner, etc.

In one example, apparatus 100 may be a laptop or desktop computer having a display 102. In this example, apparatus 100 also includes a processor 110 and memory 112. Processor 110 may be, for example, a graphic processor (e.g., GPU), an application processor (AP), a general processor (e.g., APU, accelerated processing unit; GPGPU, general-purpose computing on GPU), or any other suitable processor. Memory 112 may be, for example, a discrete frame buffer or a unified memory. Processor 110 is configured to generate display data 106 in display frames and temporally store display data 106 in memory 112 before sending it to control logic 104. Processor 110 may also generate other data, such as but not limited to, control instructions 114 or test signals, and provide them to control logic 104 directly or through memory 112. Control logic 104 then receives display data 106 from memory 112 or from processor 110 directly.

In another example, apparatus 100 may be a television set having display 102. In this example, apparatus 100 also includes a receiver 116, such as but not limited to, an antenna, radio frequency receiver, digital signal tuner, digital display connectors, e.g., high-definition multimedia interface (HDMI), digital visual interface (DVI), DisplayPort (DP), universal serial bus (USB), Bluetooth, WiFi receiver, or Ethernet port. Receiver 116 is configured to receive display data 106 as an input of apparatus 100 and provide the native or modulated display data 106 to control logic 104.

In still another example, apparatus 100 may be a handheld or VR/AR device, such as a smartphone, a tablet, or a VR headset. In this example, apparatus 100 includes processor 110, memory 112, and receiver 116. Apparatus 100 may both generate display data 106 by processor 110 and receive display data 106 through receiver 116. For example, apparatus 100 may be a handheld or VR/AR device that works as both a mobile television and a mobile computing device. In any event, apparatus 100 at least includes display 102 and control logic 104 as described below in detail.

Figure 2:
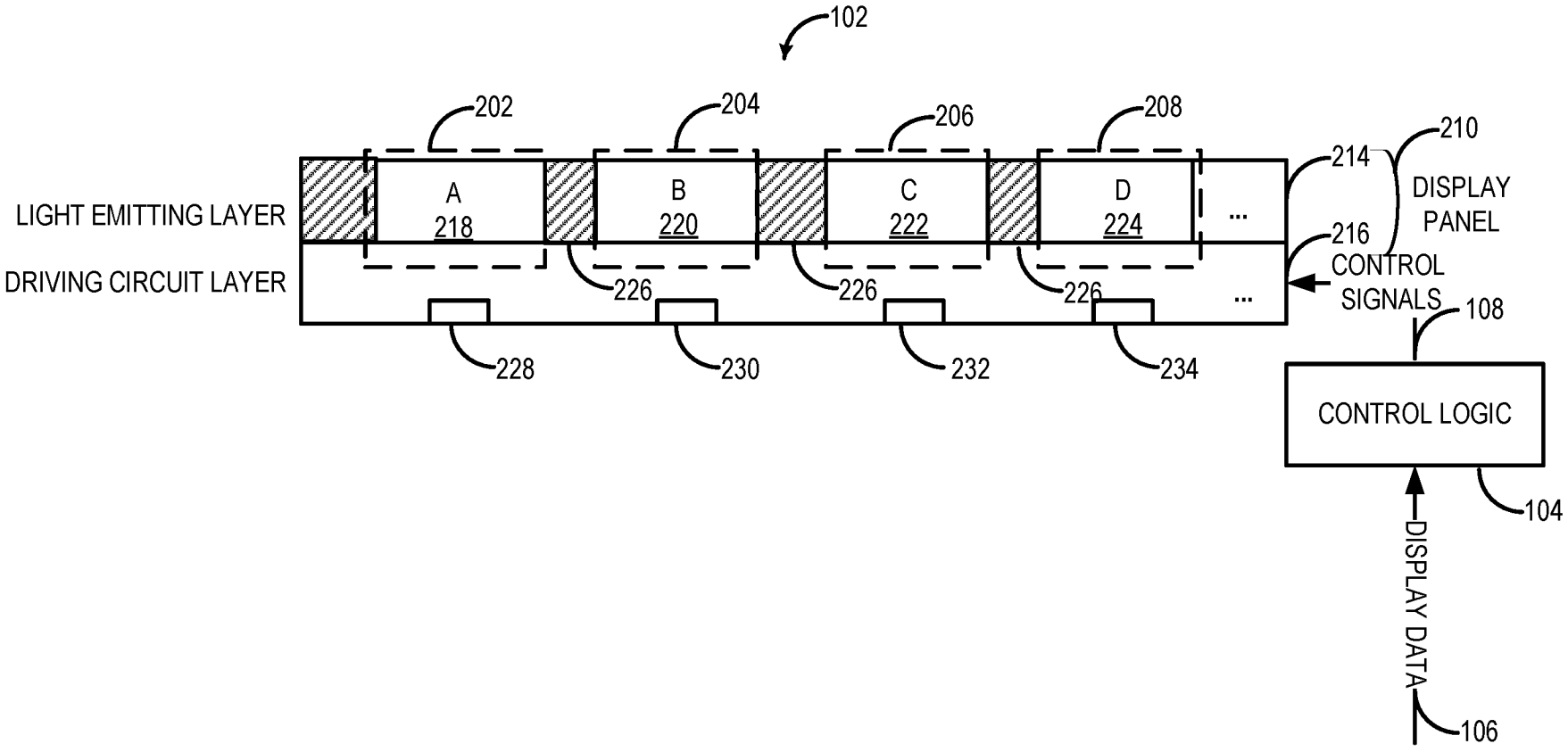
FIG. 2 is a side-view diagram illustrating an example of the display shown in FIG. 1 in accordance with various embodiments.

FIG. 2 is a side-view diagram illustrating one example of display 102 including a group of subpixels 202, 204, 206, 208. Display 102 may be any suitable type of display, for example, OLED displays, such as an AMOLED display, or any other suitable display. Display 102 may include a display panel 210 operatively coupled to control logic 104. The example shown in FIG. 2 illustrates a side-by-side (a.k.a. lateral emitter) OLED color patterning architecture in which one color of light-emitting material is deposited through metal shadow mask while the other color areas are blocked by the mask. It is understood that other color patterning architectures, such as white OLEDs with color filters (WOLED+CF) patterning architecture or blue OLEDs with transfer color filters (BOLED+transfer CF) patterning architecture, can be applied to display panel 210 as well.

In this example, display panel 210 includes a light emitting layer 214 and a driving circuit layer 216. As shown in FIG. 2A, light emitting layer 214 includes a plurality of light emitting elements (e.g., OLEDs in this example) 218, 220, 222, 224, corresponding to a plurality of subpixels 202, 204, 206, 208, respectively. A, B, C, and D in FIG. 2 denote OLEDs in different colors, such as but not limited to, red, green, blue, yellow, cyan, magenta, or white. Light emitting layer 214 also includes a black array 226 disposed between OLEDs 218, 220, 222, 224, as shown in FIG. 2. Black array 226, as the borders of subpixels 202, 204, 206, 208, is used for blocking lights coming out from the parts outside OLEDs 218, 220, 222, 224. Each OLED 218, 220, 222, 224 in light emitting layer 214 can emit light in a predetermined color and brightness.

In this example, driving circuit layer 216 includes a plurality of pixel circuits 228, 230, 232, 234, each of which includes one or more thin film transistors (TFTs), corresponding to OLEDs 218, 220, 222, 224 of subpixels 202, 204, 206, 208, respectively. Pixel circuits 228, 230, 232, 234 may be individually addressed by control signals 108 from control logic 104 and configured to drive corresponding subpixels 202, 204, 206, 208, by controlling the light emitting from respective OLEDs 218, 220, 222, 224, according to control signals 108. Driving circuit layer 216 may further include one or more drivers (not shown) formed on the same substrate as pixel circuits 228, 230, 232, 234. The on-panel drivers may include circuits for controlling light emitting, gate scanning, and data writing as described below in detail. Scan lines and data lines are also formed in driving circuit layer 216 for transmitting scan signals and data signals, respectively (as part of control signals 108), from the drivers to each pixel circuit 228, 230, 232, 234. Display panel 210 may include any other suitable component, such as one or more glass substrates, polarization layers, or a touch panel (not shown) as known in the art. Pixel circuits 228, 230, 232, 234 and other components in driving circuit layer 216 in this example are formed on a low-temperature polycrystalline silicon (LTPS) layer deposited on a glass substrate, and the TFTs in each pixel circuit 228, 230, 232, 234 are p-type transistors (e.g., PMOS LTPS-TFTs). In some embodiments, the components in driving circuit layer 216 may be formed on an amorphous silicon (a-Si) layer, and the TFTs in each pixel circuit may be n-type transistors (e.g., NMOS TFTs). In some embodiments, the TFTs in each pixel circuit may be organic TFTs (OTFT) or indium gallium zinc oxide (IGZO) TFTs.

As shown in FIG. 2, each subpixel 202, 204, 206, 208 is formed by at least an OLED 218, 220, 222, 224 driven by a corresponding pixel circuit 228, 230, 232, 234. Each OLED may be formed by a sandwich structure of an anode, an organic light-emitting layer, and a cathode, as known in the art. Depending on the characteristics (e.g., material, structure, etc.) of the organic light-emitting layer of the respective OLED, a subpixel may present a distinct color and brightness. Each OLED 218, 220, 222, 224 in this example is a top-emitting OLED. In some embodiments, the OLED may be in a different configuration, such as a bottom-emitting OLED. In one example, one pixel may consist of three adjacent subpixels, such as subpixels in the three primary colors (red, green, and blue) to present a full color. In another example, one pixel may consist of four adjacent subpixels, such as subpixels in the three primary colors (red, green, and blue) and the white color. In still another example, one pixel may consist of two adjacent subpixels. For example, subpixels A 202 and B 204 may constitute one pixel, and subpixels C 206 and D 208 may constitute another pixel. Here, since the display data 106 is usually programmed at the pixel level, the two subpixels of each pixel or the multiple subpixels of several adjacent pixels may be addressed collectively by subpixel rendering to present the appropriate brightness and color of each pixel, as designated in display data 106 (e.g., pixel data), with the help of subpixel rendering. However, it is to be appreciated that, in some embodiments, display data 106 may be programmed at the subpixel level such that display data 106 can directly address individual subpixel without the need of subpixel rendering. Because it usually requires three primary colors (red, green, and blue) to present a full color, specifically designed subpixel arrangements are provided for display 102 in conjunction with subpixel rendering algorithms to achieve an appropriate apparent color resolution.

Figure 3:
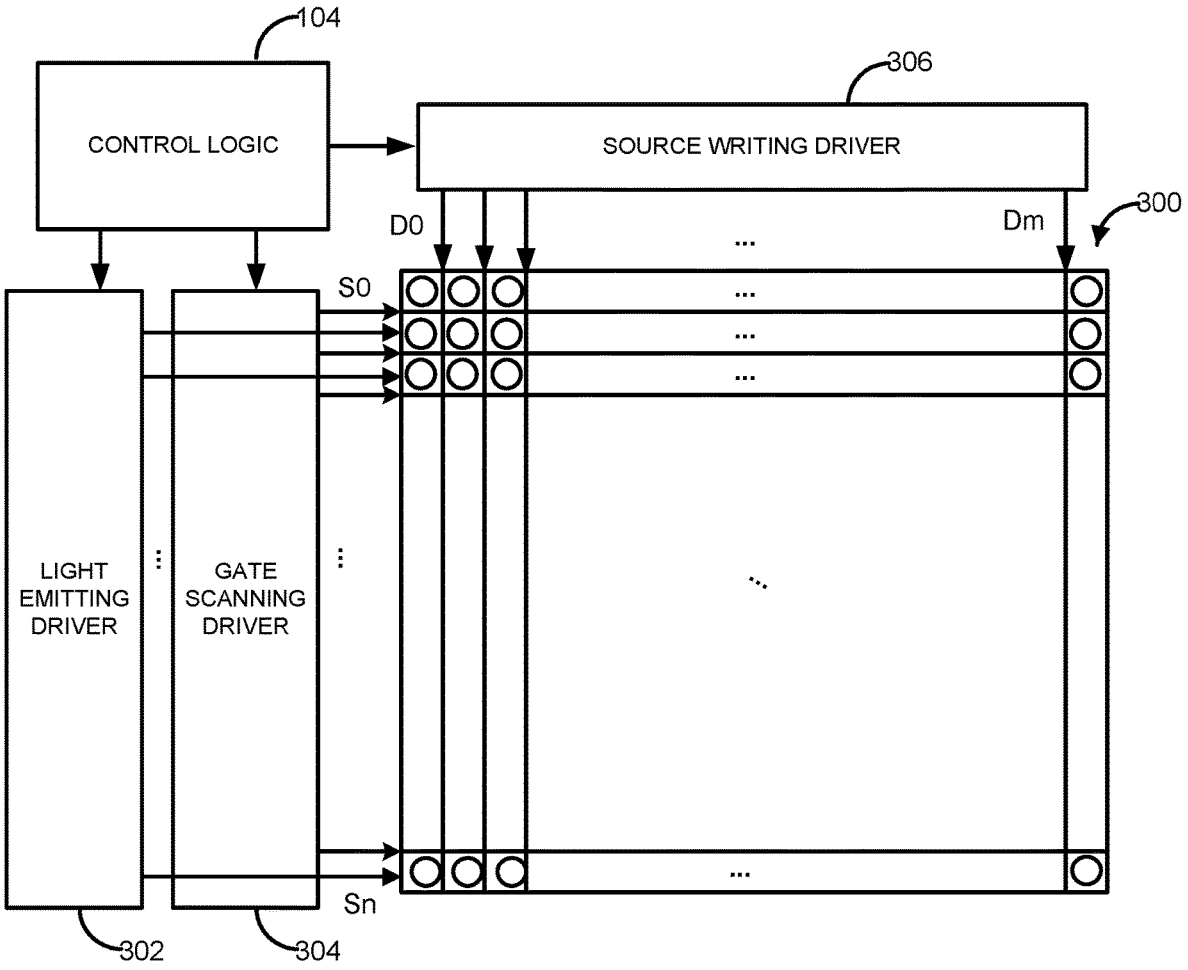
FIG. 3 is a plan-view diagram illustrating the display shown in FIG. 1 including driving units in accordance with an embodiment.

FIG. 3 is a plan-view diagram illustrating driving units 103 shown in FIG. 1 including multiple drivers in accordance with an embodiment. Display panel 210 in this embodiment includes an array of subpixels 300 (e.g., OLEDs), a plurality of pixel circuits (not shown), and multiple on-panel drivers including a light emitting driver 302, a gate scanning driver 304, and a source writing driver 306. The pixel circuits are operatively coupled to array of subpixels 300 and on-panel drivers 302, 304, and 306. Light emitting driver 302 in this embodiment is configured to cause array of subpixels 300 to emit lights in each frame. It is to be appreciated that although one light emitting driver 302 is illustrated in FIG. 3, in some embodiments, multiple light emitting drivers may work in conjunction with each other.

Gate scanning driver 304 in this embodiment applies a plurality of scan signals S0-Sn, which are generated based on control signals 108 from control logic 104, to the scan lines (a.k.a. gate lines) for each row of subpixels in array of subpixels 300 in a sequence. The scan signals S0-Sn are applied to the gate electrode of a switching transistor of each pixel circuit during the scan/charging period to turn on the switching transistor so that the data signal for the corresponding subpixel can be written by source writing driver 306. As will be described below in detail, the sequence of applying the scan signals to each row of array of subpixels 300 (i.e., the gate scanning order) may vary in different embodiments. It is to be appreciated that although one gate scanning driver 304 is illustrated in FIG. 3, in some embodiments, multiple gate scanning drivers may work in conjunction with each other to scan array of subpixels 300.

Source writing driver 306 in this embodiment is configured to write display data received from control logic 104 into array of subpixels 300 in each frame. For example, source writing driver 306 may simultaneously apply data signals DO-Dm to the data lines (a.k.a. source lines) for each column of subpixels. That is, source writing driver 306 may include one or more shift registers, digital-analog converter (DAC), multiplexers (MUX), and arithmetic circuit for controlling a timing of application of voltage to the source electrode of the switching transistor of each pixel circuit (i.e., during the scan/charging period in each frame) and a magnitude of the applied voltage according to gradations of display data 106. It is to be appreciated that although one source writing driver 306 is illustrated in FIG. 3, in some embodiments, multiple source writing drivers may work in conjunction with each other to apply the data signals to the data lines for each column of subpixels.

Figure 4:
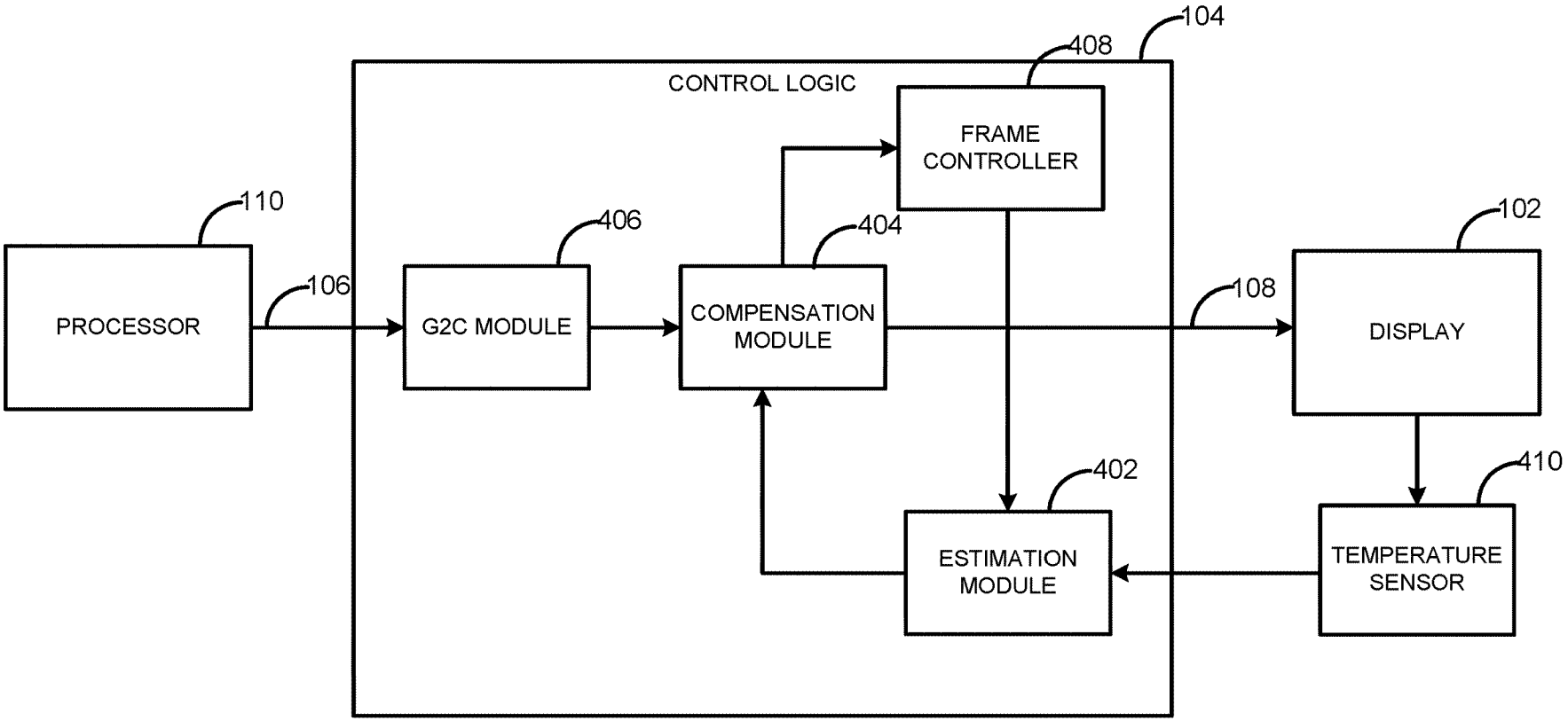
FIG. 4 is a detailed block diagram illustrating an example of the control logic shown in FIG. 1 in accordance with an embodiment.

FIG. 4 is a detailed block diagram illustrating an example of control logic 104 shown in FIG. 1 in accordance with an embodiment. In this example, control logic 104 includes estimation module 402 for aging estimation, compensation module 404 for aging compensation, a grayscale-to-current (G2C) module 406, and a frame controller 408. Control logic 104 may receive display data 106 (e.g., pixel data) in display frames from processor 110 and provide control signals 108 (e.g., including adjusted current or grayscale) to display 102 (e.g., display panel 210 thereof). In some embodiments, a temperature sensor 410 is provided to measure the environment temperature of display panel 210 in display 102 and provide the environment temperature to estimation module 402 of control logic 104.

When the luminance information of each pixel or subpixel in display data 106 is represented by grayscales (e.g., 0-255), G2C module 406 may be configured to convert the grayscales in display data 106 into currents. In some embodiments, G2C module 406 provides a current associated with each light emitting elements in display panel 210. For example, grayscale g can be converted into current c according to a grayscale-current relationship:

$$c = G * \left(\frac{g}{G}\right)^{\gamma},$$

where G is me maximum grayscale, e.g., 255, and γ is the grayscale-current index. In one example, γ is 2.2. γ may be adjusted in some embodiments based on the conditions of display panel 210. It is understood that the "current" associated with a light emitting element (e.g., an OLED) referred to herein does not represent the actual value of the current signal, but instead, is a normalized value according to the grayscale-current relationship. In some embodiments, the current associated with the light emitting element determines the luminance of the light emitting element and thus, can be used to represent the luminance of the light emitting element.

Frame controller 408 may be configured to control the sampling time interval Δt of estimation module 402 to control the size of the data to be processed by estimation module 402. In some embodiments, due to the limitation such as storage space and power consumption, not all display data 106 needs to be processed by estimation module 402 for aging estimation. Frame controller 408 can sample some of the display frames at the sampling time interval Δt, e.g., in every n frames or every n seconds.

Figure 5:
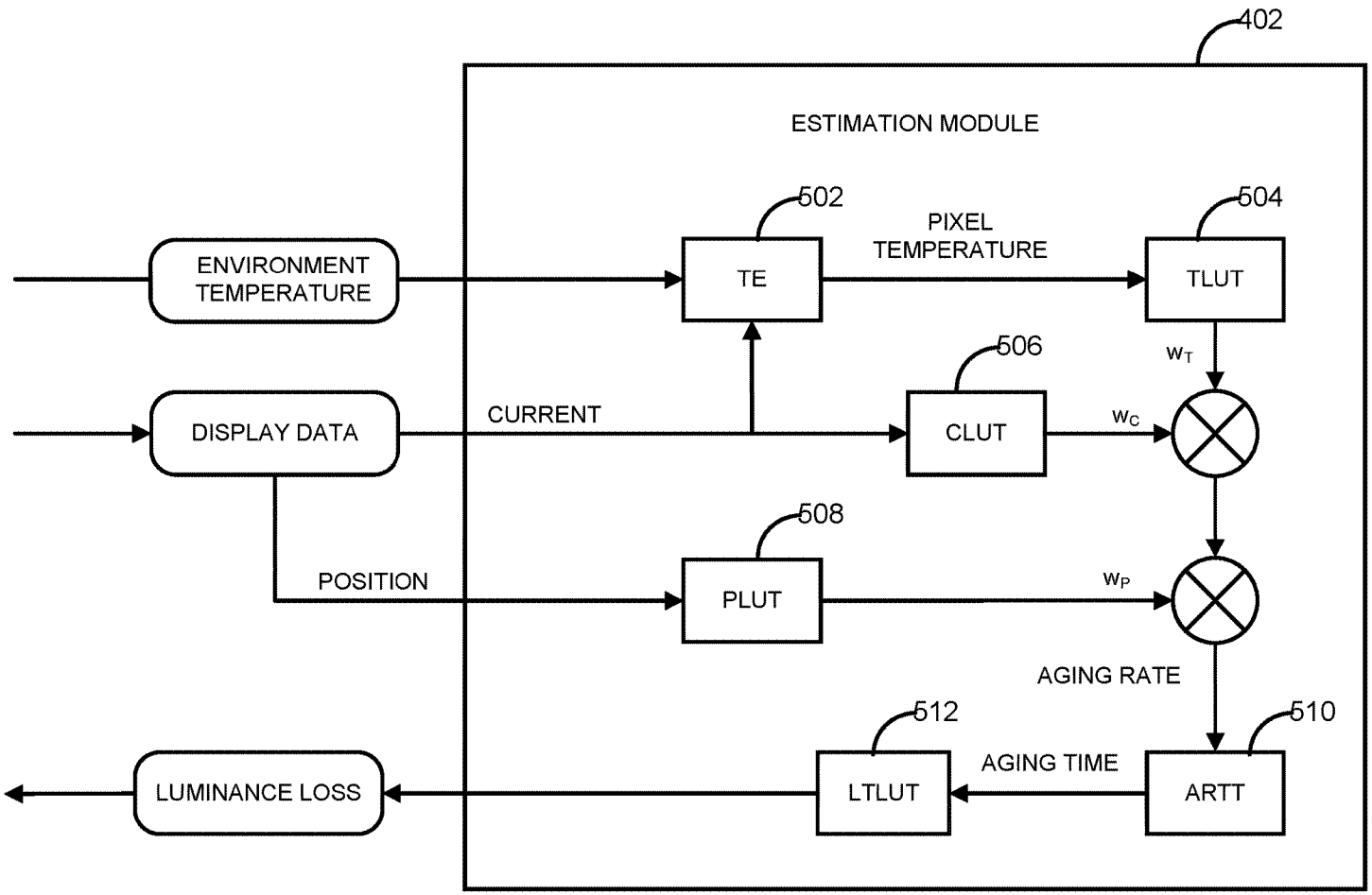
FIG. 5 is a detailed block diagram illustrating an example of an estimation module in the control logic shown in FIG. 4 in accordance with an embodiment.

Estimation module 402 may be configured to estimate the aging of a light emitting element (e.g., an OLED) in display panel 210 of display 102, for example, by determining the luminance loss of the light emitting element based on multiple factors including the current, position, and temperature associated with the light emitting element. Estimation module 402 may be continuously running at the sampling time interval Δt controlled by frame controller 408 to constantly update the luminance losses of the light emitting elements in display panel 210. The luminance losses of the light emitting elements provided by estimation module 402 thus become historical luminance losses of the light emitting elements that can be fed into compensation module 404 as a basis for determining the luminance target for aging compensation. FIG. 5 is a detailed block diagram illustrating an example of estimation module 402 in control logic 104 shown in FIG. 4 in accordance with an embodiment. In this example, estimation module 402 includes a temperature estimator (TE) 502, a temperature lookup table (TLUT) 504, a current lookup table (CLUT) 506, a position lookup table (PLUT) 508, an aging rate to time unit (ARTT) 510, and a luminance loss-aging time lookup table (LTLUT) 512.

Figure 6:
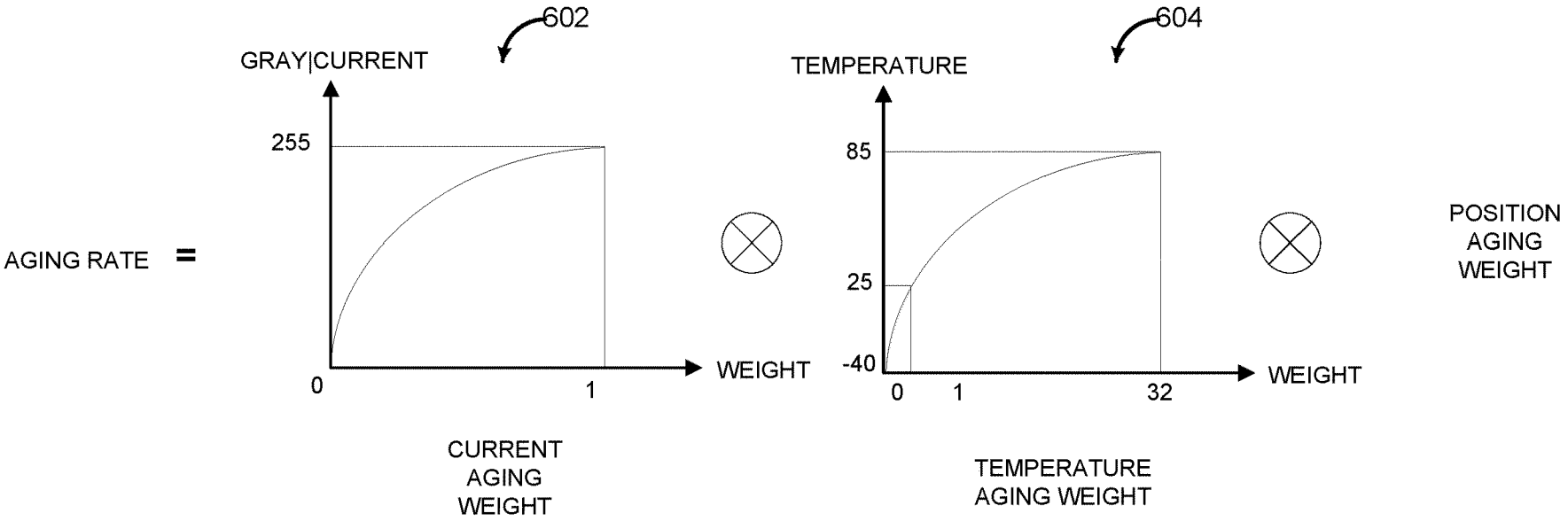
FIG. 6 is a depiction of an example of determining an aging rate based on a current aging weight, a temperature aging weight, and a position aging weight in accordance with an embodiment.

In some embodiments, the display data sampled by frame controller 408 at the sampling time interval Δt is provided to estimation module 402. The display data may include the current associated with each light emitting element converted by G2C module 406. The current associated with a light emitting element may be used to determine a current aging weight We of the light emitting element using CLUT 506. In some embodiments, CLUT 506 represents a current-aging relationship measured at a standard temperature to mitigate the impact of various temperatures on the current-aging relationship. It is understood that because all possible relationships between aging and different temperatures and different currents (luminance) cannot be exhausted, it is assumed that the impact of temperature on aging and the impact of current on aging are independent. As a result, a current-aging relationship measured at a standard temperature, e.g., CLUT 506, can be used as the statistic baseline onto which light emitting diode aging at different currents can be mapped. The standard temperature can be any suitable preset temperature. FIG. 6 illustrates one example of a CLUT 602, which illustrates the current aging weights (between 0 and 1) at different grayscales (between 0 and 255, which can be converted into currents) at the standard temperature. Based on CLUT 602, the grayscale or current associated with a light emitting element can be converted into a corresponding current aging weight.

In some embodiments, the current-aging relationship (e.g., CLUT 506 and 602) and current aging weight are color-dependent. For example, for light emitting elements in different colors (e.g., red OLEDs, green OLEDs, and blue OLEDs), the current-aging relationship and the resulting current aging weight are determined based on the color of the light emitting element. In some embodiments, the current-aging relationship is measured by, for each of the red, green, and blue OLEDs, measuring the OLEDs at a plurality of grayscales at a measuring time interval, converting the grayscales into currents, and determining current aging weights of the OLEDs based on luminance losses of the OLEDs between the measuring time interval. In one example, assuming the surface temperature of display panel 210 is maintained at a standard temperature, for each of the red, green, and blue OLEDs, the OLEDs are respectively turned on at N grayscales (e.g., 7 gray scales: 64, 128, 192, 224, 240, 248, and 255), resulting 3N checkerboard patterns. At the measuring time interval (e.g., every 12 hours) in the measuring period (e.g., 240 hours), the luminance of each of the 3N checkerboard patterns is measured. The derivative of luminance loss between every two consecutive measurements (between the measuring time interval) is the measured current aging weight of the red, green, or blue OLED. In some embodiments, the grayscales are converted into currents as described above in detail.

In some embodiments, to maintain the surface temperature of display panel 210, both sides of display panel 210 are covered with a thermal-conductive membrane (e.g., with a thermal conductive coefficient greater than 1500 W/m·K), and a temperature sensor is attached to the front side of display panel 210. A thermostat then can be used to adjust the environment temperature to control the surface temperature of display panel 210. In one example, temperature control can be individually performed for each of the 3N checkerboard patterns.

Similarly, the temperature associated with a light emitting element (pixel temperature) may be used to determine a temperature aging weight $W_T$ of the light emitting element using TLUT 504. In some embodiments, TLUT 504 represents a temperature-aging relationship measured at a standard current (luminance) to mitigate the impact of various currents on the temperature-aging relationship. It is understood that because all possible relationships between aging and different temperatures and different currents (luminance) cannot be exhausted, it is assumed that the impact of temperature on aging and the impact of current on aging are independent. As a result, a temperature-aging relationship measured at a standard current, e.g., TLUT 504, can be used as the statistic baseline onto which light emitting diode aging at different temperatures can be mapped. The standard current can be any suitable preset current. FIG. 6 illustrates one example of a TLUT 604, which illustrates the temperature aging weights (between 0 and 32) at different temperature (between −40° C. and 85° C.) at the current temperature. Based on TLUT 604, the pixel temperature associated with a light emitting element can be converted into a corresponding temperature aging weight.

In some embodiments, the temperature-aging relationship (e.g., TLUT 504 and 604) and temperature aging weight are color-dependent. For example, for light emitting elements in different colors (e.g., red OLEDs, green OLEDs, and blue OLEDs), the temperature-aging relationship and the resulting temperature aging weight are determined based on the color of the light emitting element. In some embodiments, the temperature-aging relationship is measured by, for each of the red, green, and blue OLEDs, measuring the OLEDs at a plurality of pixel temperatures at a measuring time interval, and determining temperature aging weights of the OLEDs based on luminance losses of the OLEDs between the measuring time interval. In one example, assuming display panel 210 is maintained at a standard luminance (current), for each of the red, green, and blue OLEDs, pixel temperatures of the OLEDs are respectively set at M different degrees (e.g., every 5° C. between −40° C. and 85° C., resulting in 26 different degrees). At the measuring time interval (e.g., every 12 hours) in the measuring period (e.g., 240 hours), the luminance of each of the M different degrees is measured. The derivative of luminance loss between every two consecutive measurements (between the measuring time interval) is the measured temperature aging weight of the red, green, or blue OLED.

In addition to grayscales and currents information, position information, e.g., the position associated with a light emitting element in display panel 210, can be determined from the sampled display data as well. The position of a light emitting element may be used to determine a position aging weight $W_P$ of the light emitting element using PLUT 508. In some embodiments, PLUT 508 represents a position-aging relationship that may be manually set or measured based on the spatial differences between different positions caused by fabrication processes, packaging, heat dissipation, etc. In some embodiments, PLUT 508 does not provide the position aging weights of each light emitting element in display panel 210. Instead, display panel 210 may be divided into an N by M matrix depending on the display resolution and/or size, and the position aging weights of each matrix unit may be provided in PLUT 508. The position aging weight of each light emitting element thus can be determined based on the matrix unit it belongs to using interpolation, such as bilinear interpolation.

Since the pixel temperatures may not be directly measured, in some embodiments, the environment temperature $T_E$ associated with display panel 210 measured by temperature sensor 410 is used to determine the pixel temperatures by TE 502. TE 502 may be configured to calculate the pixel temperature associated with a light emitting element based on the environment temperature, the current associated with the light emitting element, and a current-temperature factor. In one example, the pixel temperature Tp is measured according to $T_p=T_E+K_c*C_c$, where $C_c$ is the current associated with the light emitting element, and $K_c$ is the current-temperature factor. For example, $K_c$ can be measured by, for each of the red, green, and blue OLEDs, measuring the temperature at the center of display panel 210 at different grayscales (e.g., 32, 64, 96, 128, 160, 192, 224, 255) and calculating $K_c$ based on the environment temperature $T_E$. In some embodiments, measurements between different grayscales are waited (e.g., for five minutes) before proceeding to allow the temperature to be stable. In some embodiments, $K_c$ is the average value of multiple measurements at different environment temperatures. Due to temperature overlapping from light emitting elements of different colors, the pixel temperature Tp may be measured according to $T_p=T_E+K_{cR}*C_{cR}+K_{cG}*C_{cG}+K_{cB}*C_{cB}$.

After determining the current aging weight $W_C$, the temperature aging weight $W_T$, and the position aging weight $W_p$ of a light emitting element, control logic 104 is further configured to determine the aging rate $v_E$ of the light emitting element based on the current aging weight $W_C$, the temperature aging weight $W_T$, and the position aging weight $W_P$. As shown in FIGS. 5 and 6, in one example, the aging rate $v_E$ is calculated according to $v_E=W_C*W_T*W_P$. As described above, because all possible relationships between aging and different temperatures and different currents (luminance) cannot be exhausted, it is assumed that the impact of temperature on aging and the impact of current on aging are independent.

ARTT 510 may be configured to determine the aging time $T_H$ of the light emitting element may be determined based on the aging rate $v_E$ of the light emitting element and the sampling time interval Δt. In some embodiments, the aging time of the light emitting element is determined based on the last aging time, the aging rate of the light emitting element, and the time interval. In one example, the aging time $T_H$ of the light emitting element is calculated according to $T_H=T'_H+v_E*\Delta t$, where $T'_H$ is the last aging time of the last measurement, and $\Delta t*v_E$ represent the aging time increase at the sampling time interval Δt.

The luminance loss of the light emitting element may be determined based on the aging time $T_H$ and LTLUT 512. In some embodiments, LTLUT 512 represents a luminance loss-aging time relationship measured at the standard temperature and the standard current. In some embodiments, the luminance loss-aging time relationship (e.g., LTLUT 512) is measured by, for each of the red, green, and blue OLEDs, measuring the OLEDs at a grayscale at a measuring time interval. To reduce the measurement time, the luminance loss-aging time relationship may be measured at the maximum grayscale. In some embodiments, LTLUT 512 may be represented by fitting the equation of $$\frac{L}{L_0}=\left[-\left(\frac{t}{\tau}\right)^{\beta}\right],$$

where t is the aging time; L is the OLED luminance at t, $L_0$ is initial OLED luminance, τ is time scale of decay, and β is a stretching exponent. In one example, at the standard current and standard temperature, the luminance is measured at a measuring time interval (e.g., every 12 hours) for a measuring period (e.g., 480 hours). In some embodiments, to reduce the amount of data, the luminance loss data is compressed based on a grid of display panels, for example, having 2×2 or 4×4 adjacent light emitting elements.

Figure 7:
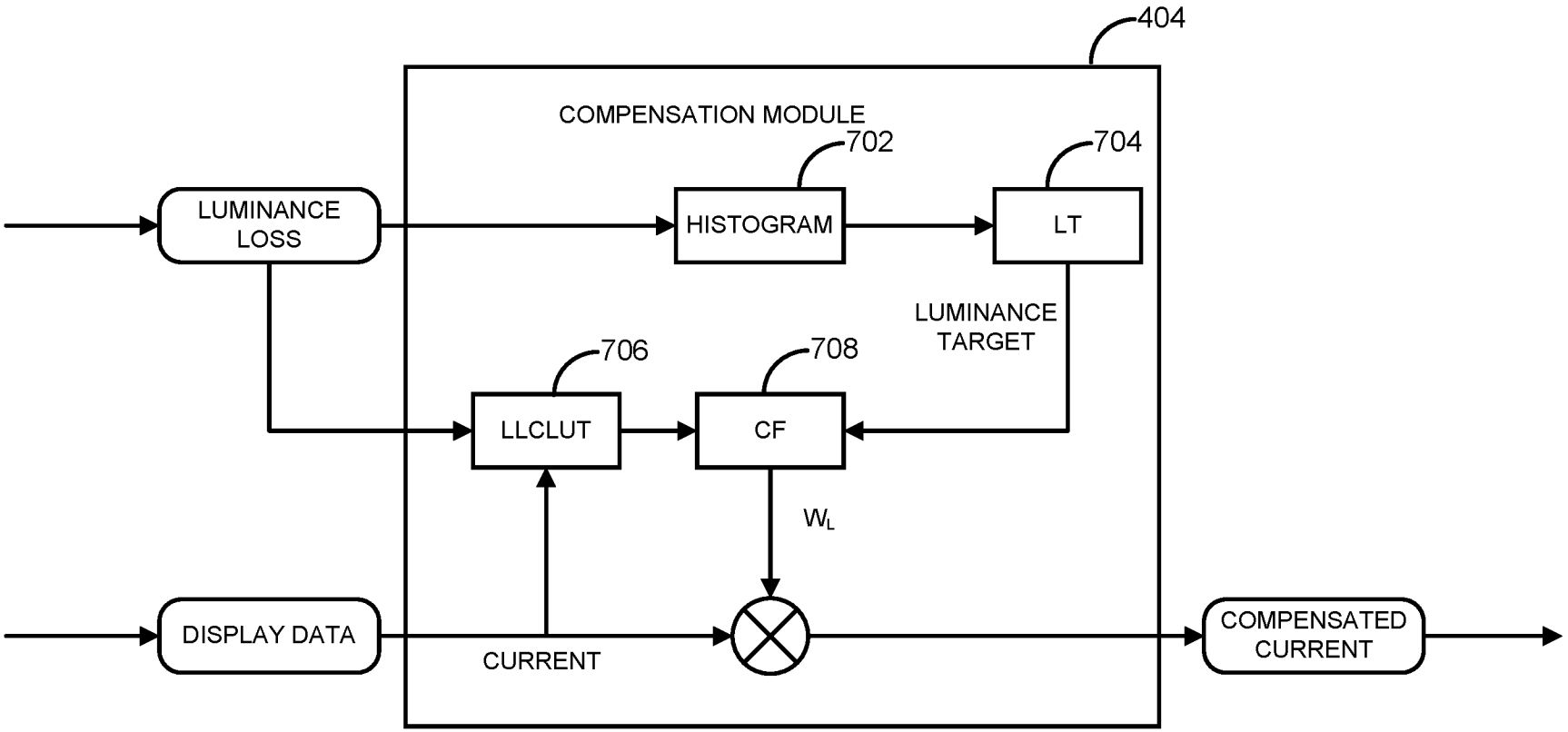
FIG. 7 is a detailed block diagram illustrating an example of a compensation module in the control logic shown in FIG. 4 in accordance with an embodiment.

Referring back to FIG. 4, the luminance loss data may be continuously updated by estimation module 402 for light emitting elements at the sampling interval and provided to compensation module 404 as historical luminance loss data. Compensation module 404 may be configured to determine a luminance target based on the historical luminance data provided by estimation module 402 and dynamically compensate the aging of a light emitting element based on the luminance target by controlling the output of a compensated current to the light emitting element. For example, FIG. 7 is a detailed block diagram illustrating an example of compensation module 404 in control logic 104 shown in FIG. 4 in accordance with an embodiment. In this example, compensation module 404 includes a histogram unit 702, a luminance target unit (LT) 704, a luminance loss correction lookup table (LLCLUT) 706, and a compensation factor unit (CF) 708.

Compensation module 404 may be configured to determining a luminance target (the goal of aging compensation for each light emitting element) based on the historical luminance losses of a plurality of light emitting elements in display panel 210. In some embodiment, the historical luminance losses are for all the light emitting elements in display panel 210. In some embodiments, histogram unit 702 is configured to determine a maximum historical luminance loss of one of the plurality of light emitting elements based on a histogram of the historical luminance losses. A histogram is an accurate representation of the distribution of numerical data, such as the historical luminance losses. Histogram can be used for assisting the determination of the luminance target, deciding the tolerance margin for aging compensation, and/or excluding abnormally-aged light emitting elements. In some embodiments, the maximum historical luminance loss of one of the plurality of light emitting elements is determined based on the distribution of the historical luminance losses. It is understood that the historical luminance losses from a number of abnormally-aged light emitting elements may be first excluded based on their distribution in the histogram before determining the maximum historical luminance loss.

In some embodiments, LT 704 sets the maximum historical luminance loss as the luminance target to ensure that all the light emitting elements can be effectively compensated. That is, the luminance target $L_t$ may be set according to $L_t$=Max(LL), where Max(LL) is the maximum historical luminance loss. In some embodiments, LT 704 sets the maximum historical luminance loss adjusted by a target percentage R as the luminance target to balance the user experience between compensation effect and overall brightness. The target percentage can be preset, for example, a value between 0 and 1. That is, the luminance target $L_t$ may be set according to $L_t$=Max(LL)$^x$. Another way to look at this example is that the luminance target may be set based on zero, the maximum historical luminance loss, and the target percentage. For example, the luminance target $L_t$ may be set according to $L_t$=Histogram(0, Max(LL), R), wherein Histogram (A, B, C) is a function that returns the luminance target between A and B according to the percentage C.

In some embodiments, a minimum historical luminance loss of one of the plurality of light emitting elements is considered as well in determining the luminance target to avoid the over-exposure caused by over-compensation to some extent. Histogram unit 702 may be configured to determine the minimum historical luminance loss of one of the plurality of light emitting elements based on the histogram of the historical luminance losses as well. In some embodiments, the luminance target is set based on the minimum historical luminance loss of one of the plurality of light emitting elements, the maximum historical luminance loss, and the target percentage. In one example, LT 704 sets the luminance target $L_t$ according to $L_t$=(Max(LL)−Min(LL))*R+Min(LL), where Min(LL) is the minimum historical luminance loss. In another example, LT 704 sets the luminance target $L_t$ according to $L_t$=Histogram(Min(LL), Max(LL),R), which returns the luminance target between the minimum and maximum luminance losses Min(LL) and Max(LL) according to the target percentage R.

It is understood that the luminance target may be manually set at any arbitrary value without considering the historical luminance loss data. It is further understood that the luminance target may be dynamically adjusted during the lifespan of display panel 210. In some embodiments, LT 704 is configured to adjust the luminance target based on the usage stage of display panel 210. For example, in the early usage stage, the luminance target may be manually set as at an initial value (e.g., 0.8) and later adjusted to other values (e.g., any suitable ways as described above) when the maximum luminance loss drops below the initial value (e.g., Max(LL)<0.8). As the aging rate of an OLED display gradually decreases during its lifespan, the example described above can avoid the quick aging in the early usage stage, which causes drastically affect user experience due to the shape brightness decrease, thereby improving user experience and extending the lifespan of the OLED display.

Figure 8:
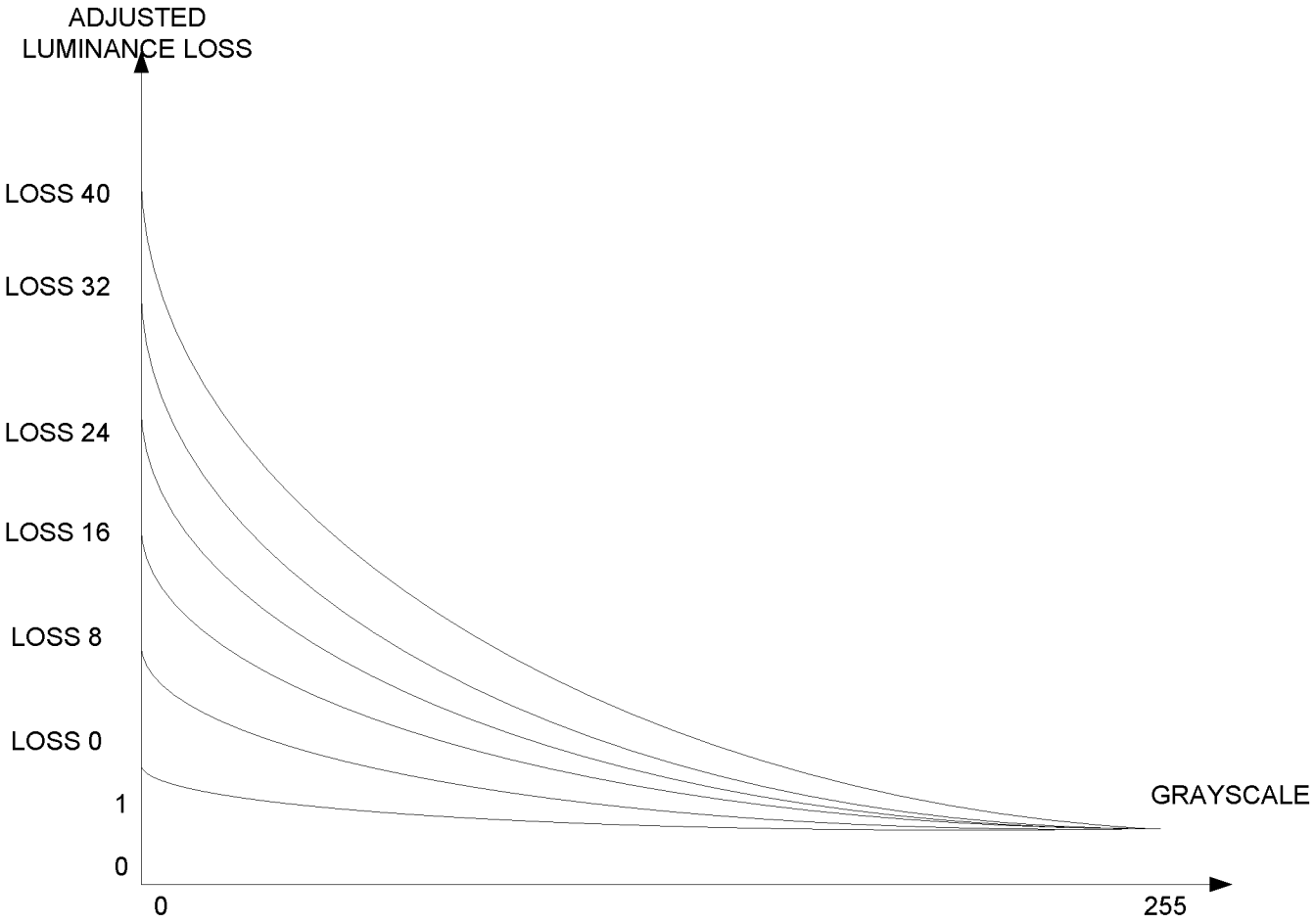
FIG. 8 is a depiction of an example of a luminance loss correction lookup table (LLCLUT) in accordance with an embodiment.

In some embodiments, compensation module 404 is further configured to determine an adjusted luminance loss of one of the plurality of light emitting elements based on the current and the luminance loss of the light emitting element. As described above, the current associated with a light emitting element may be determined from the display data, e.g., by converting the grayscale of the light emitting element into a current (luminance) using G2C module 406. As to the luminance loss of the light emitting element, it may be determined by estimation module 402 and fed into compensation module 404. That is, in addition to providing historical luminance loss data, estimation module 402 can also provide the current luminance loss of a particular light emitting element in real-time to compensation module 404 for dynamic aging compensation. In some embodiments, the adjusted luminance loss $L'_i$ of the light emitting element is determined based on the luminance loss $L_i$ and current $C_i$ of the light emitting element using LLCLUT 706. Depending on the materials and fabrication processes used for making display panel 210, a light emitting element's response to luminance may vary at different current levels and/or different levels of luminance loss, which needs to be dynamically adjusted. FIG. 8 shows an example of LLCLUT 706, which represents the relationship between the adjusted luminance losses and grayscales (e.g., between 0 and 255, which can be converted into currents) at different levels of luminance losses (e.g., 0, 8, 16, 24, 32, and 40). Based on the estimated level of luminance loss and the current (grayscale) of a light emitting element, the adjusted luminance loss of the light emitting element can be determined based on LLCLUT 706.

Figure 9:
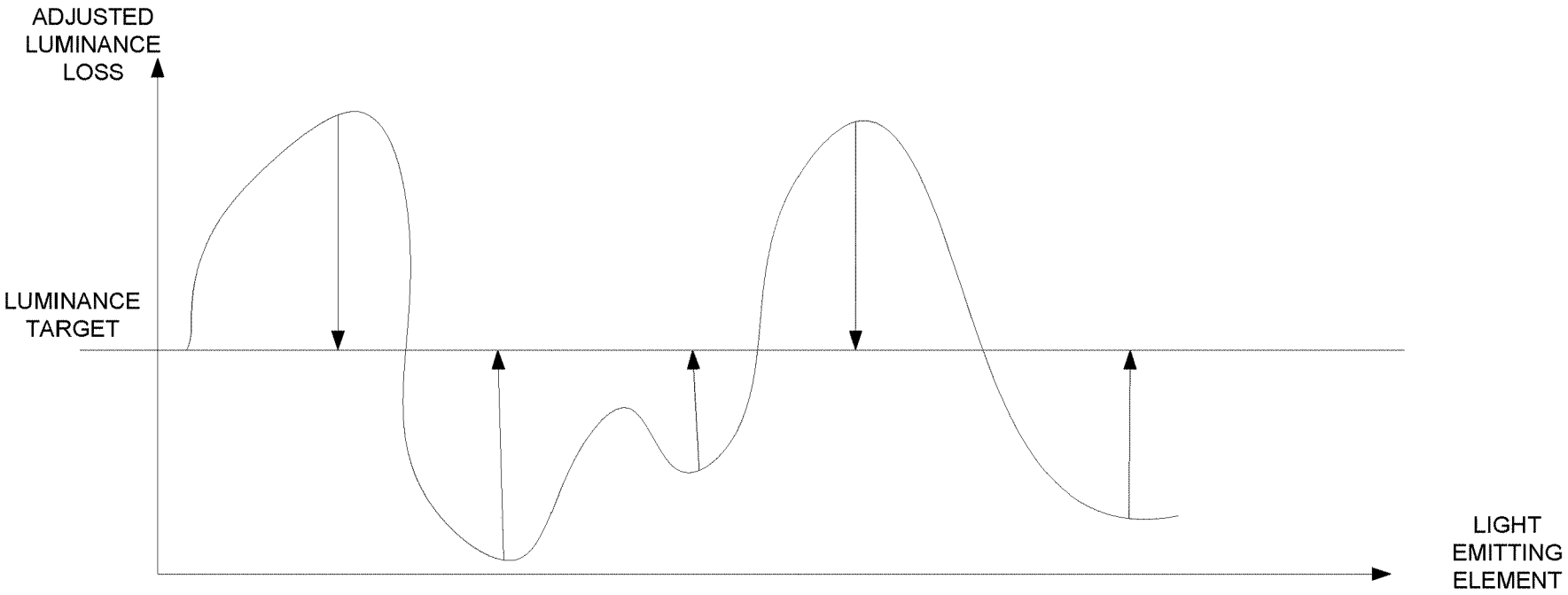
FIG. 9 is a depiction of an example of a luminance compensation lookup table (LCLUT) in accordance with an embodiment.

Referring back to FIG. 7, compensation module 404 may be further configured to determine a compensation factor $W_L$ of the light emitting element based on the adjusted luminance loss $L'_i$ of the light emitting element and the luminance target $L_t$. In some embodiments, CF 708 calculates the compensation factor $W_L$ of the light emitting element using a luminance compensation lookup table $LCLUT(L_i,L_t)=(1-L_t)/(1-L'_t)$. Data in the LUCLT may be manually adjusted or set. In one example, the LCLUT is a two-dimensional lookup table having one dimension representing the luminance target $L_t$, and another dimension representing the adjusted luminance loss $L'_i$ of the light emitting element. The range and step of the adjusted luminance losses in the LCLUT may be set to control the size of the LCLUT and/or adjust the degree of compensation. For example, the range of the adjusted luminance losses may be between 0 and 0.39 with the step of 0.01. Thus, the number of adjusted luminance losses in the LCLUT is 40. In some embodiments, the maximum adjusted luminance loss in the LCLUT is 0.4. FIG. 9 shows an example of the LCLUT. As shown in FIG. 9, for each light emitting element, its compensation factor (represented by each arrow) drags its adjusted luminance loss back to the luminance target plane.

Referring back to FIG. 7, compensation module 404 may be further configured to control the output of a compensated current to the light emitting element based on the current $C_i$ and the compensation factor $W_L$ of the light emitting element. In one example, the compensated current Cc is determined according to $Cc=C_i*W_L$. Referring back to FIG. 4, the determined values of the compensated currents may be provided to display 102 as part of control signals 108. On the other hands, the compensated currents may be provided to estimation module 402 through frame controller 408 as part of the input signals of estimation module 402.

Figure 10:
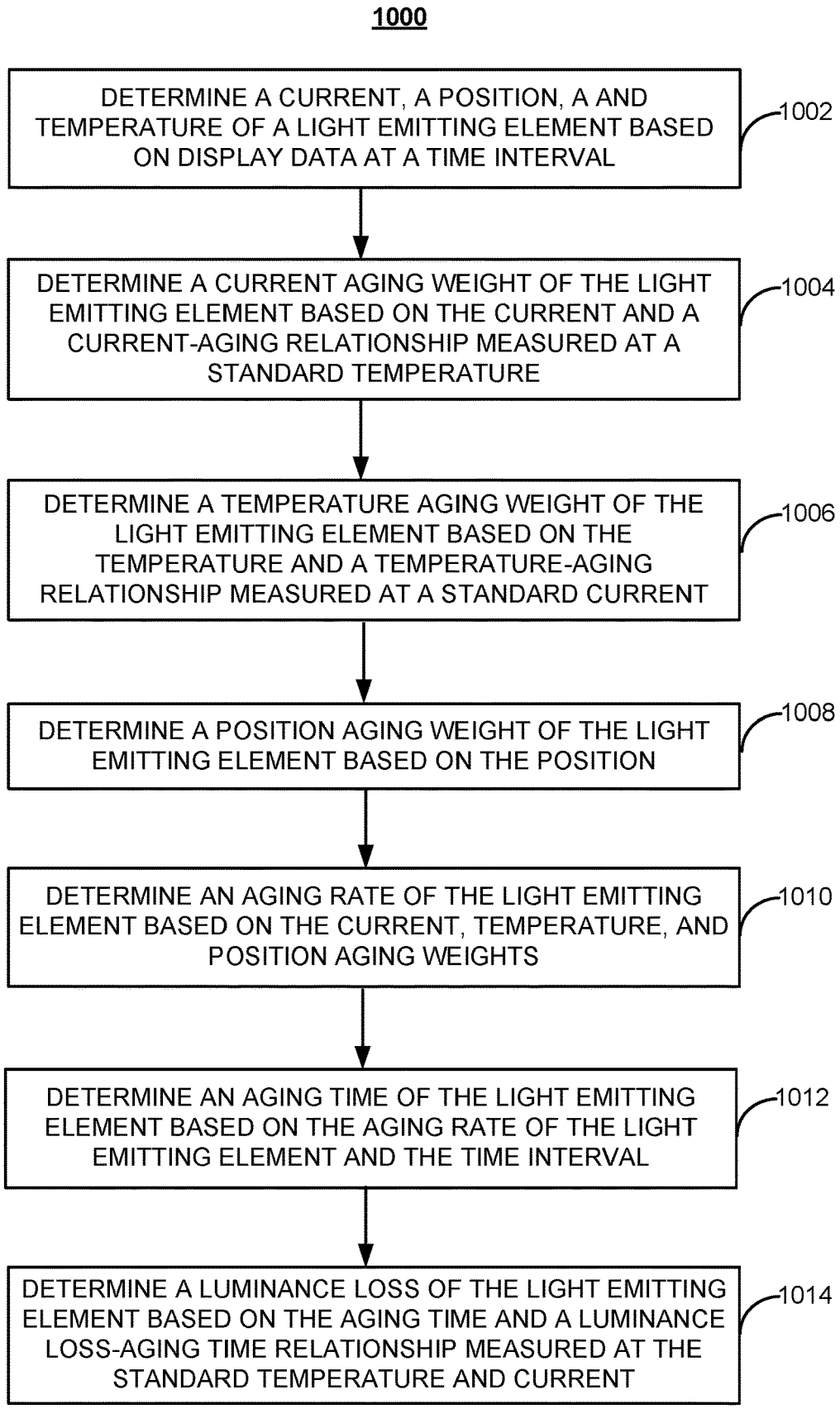
FIG. 10 is a flowchart of an exemplary method for estimating aging of light emitting elements in a display panel in accordance with an embodiment.

FIG. 10 is a flowchart of an exemplary method 1000 for estimating aging of light emitting elements in a display panel in accordance with an embodiment. The method can be performed by estimation module 402 of control logic 104 or by any suitable circuit, logic, unit, or module that can comprise hardware (e.g., circuitry, dedicated logic, programmable logic, microcode, etc.), software (e.g., instructions executing on a processing device), firmware, or a combination thereof. It is to be appreciated that not all steps may be needed to perform the disclosure provided herein. Further, some of the steps may be performed simultaneously, or in a different order than shown in FIG. 10, as will be understood by a person of ordinary skill in the art.

Starting at 1002, a current, a position, and a temperature associated with a light emitting element in a display panel are determined based on display data provided to the display panel at a time interval. The current may be converted from the grayscale associated with the light emitting element. The light emitting element may include an OLED.

At 1004, a current aging weight of the light emitting element is determined based on the current and a current-aging relationship measured at a standard temperature. In some embodiments, the OLED is a red OLED, a green OLED, or a blue OLED, and the current-aging relationship is measured based on a red, green, or blue OLED corresponding to the OLED. The current-aging relationship may be measured by, for each of the red, green, and blue OLEDs, measuring the OLEDs at a plurality of grayscales at a time interval, converting the grayscales into currents, and determining current aging weights of the OLEDs based on luminance losses of the OLEDs between the time interval.

At 1006, a temperature aging weight of the light emitting element is determined based on the temperature and a temperature-aging relationship measured at a standard current. In some embodiments, the temperature-aging relationship is measured based on a red, green, or blue OLED corresponding to the OLED. The temperature-aging relationship may be measured by, for each of the red, green, and blue OLEDs, measuring the OLEDs at a plurality of temperatures at a time interval, and determining temperature aging weights of the OLEDs based on luminance losses of the OLEDs between the time interval. In some embodiments, to determine the temperature associated with the light emitting element, an environment temperature associated with the display panel is measured, and the temperature associated with the light emitting element is calculated based on the environment temperature, the current associated with the light emitting element, and a current-temperature factor.

At 1008, a position aging weight of the light emitting element is determined based on the position. In some embodiments, the position aging weight of the light emitting element is determined based on the position and a position-aging relationship.

At 1010, an aging rate of the light emitting element is determined based on the current aging weight, the temperature aging weight, and the position aging weight.

At 1012, an aging time of the light emitting element is determined based on the aging rate of the light emitting element and the time interval. In some embodiments, the aging time of the light emitting element may be determined based on the last aging time, the aging rate of the light emitting element, and the time interval.

At 1014, a luminance loss of the light emitting element is determined based on the aging time and a luminance loss-aging time relationship measured at the standard temperature and the standard current.

Figure 11:
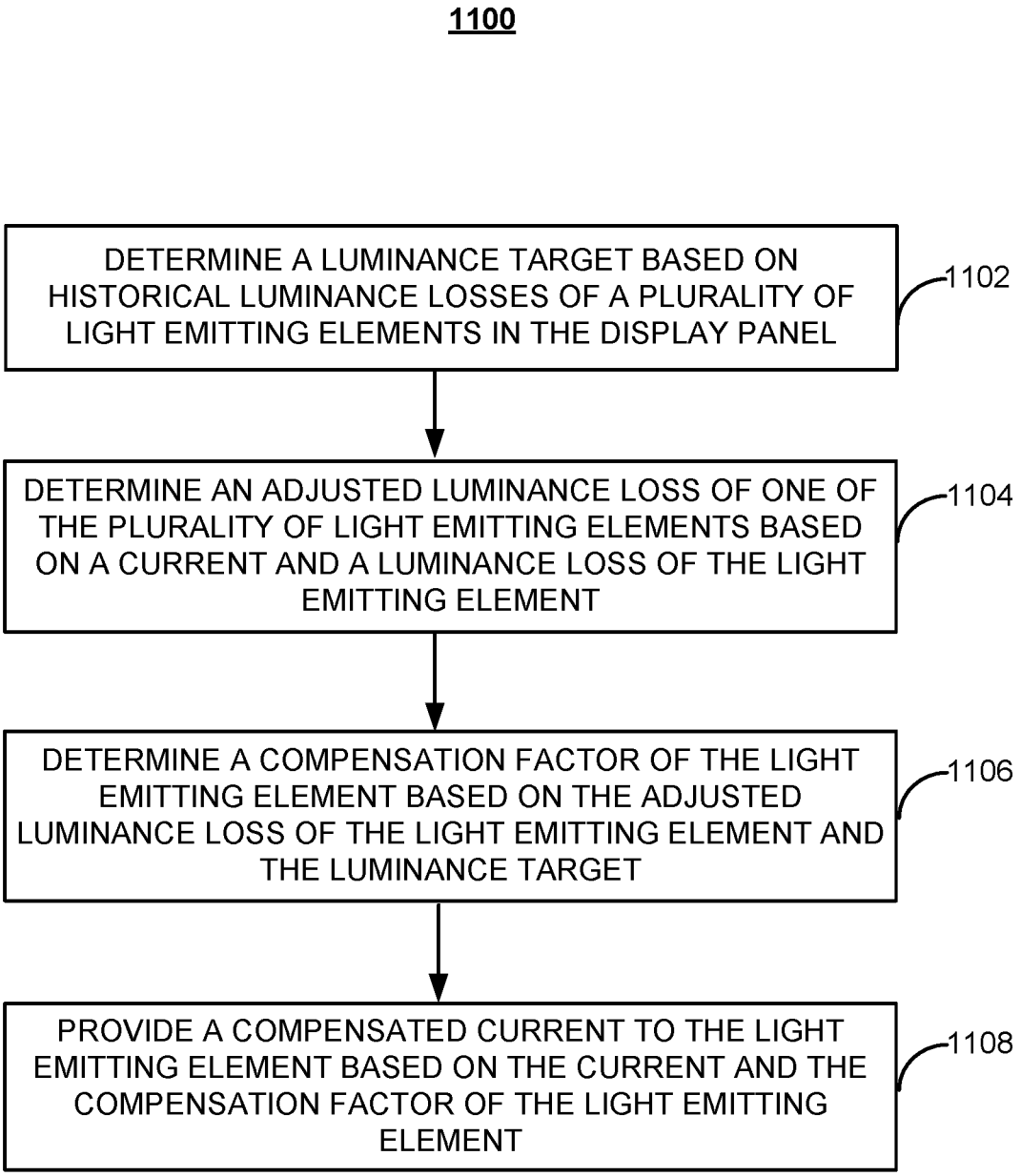
FIG. 11 is a flowchart of an exemplary method for compensating aging of light emitting elements in a display panel in accordance with an embodiment.

FIG. 11 is a flowchart of an exemplary method 1100 for compensating aging of light emitting elements in a display panel in accordance with an embodiment. The method can be performed by compensation module 404 of control logic 104 or by any suitable circuit, logic, unit, or module that can comprise hardware (e.g., circuitry, dedicated logic, programmable logic, microcode, etc.), software (e.g., instructions executing on a processing device), firmware, or a combination thereof. It is to be appreciated that not all steps may be needed to perform the disclosure provided herein. Further, some of the steps may be performed simultaneously, or in a different order than shown in FIG. 11, as will be understood by a person of ordinary skill in the art.

Starting at 1102, a luminance target is determined based on historical luminance losses of a plurality of light emitting elements in the display panel. In some embodiments, a maximum historical luminance loss of one of the plurality of light emitting elements is determined based on a histogram of the historical luminance losses. The maximum historical luminance loss may be set as the luminance target. In some embodiments, the luminance target is set based on the maximum historical luminance loss and a target percentage. In some embodiments, the luminance target is set based on zero, the maximum historical luminance loss, and the target percentage. In some embodiments, the luminance target is set based on a minimum historical luminance loss of one of the plurality of light emitting elements, the maximum historical luminance loss, and the target percentage. The luminance target may be adjusted based on a usage stage of the display panel.

At 1104, an adjusted luminance loss of one of the plurality of light emitting elements is determined based on a current and a luminance loss of the light emitting element.

At 1106, a compensation factor of the light emitting element is determined based on the adjusted luminance loss of the light emitting element and the luminance target.

At 1108, a compensated current to the light emitting element is determined based on the current and the compensation factor of the light emitting element.

It is understood that a method for dynamically compensating aging of light emitting elements in a display panel may be performed by compensation module 404 in conjunction with estimation module 402 of control logic 104. For example, steps 1002 to 1014 in FIG. 10 and steps 1102 to 1108 in FIG. 11 as described above in detail may be performed for dynamically compensating aging of light emitting elements in a display panel, which are not repeated herein.

The above detailed description of the disclosure and the examples described therein have been presented for the purposes of illustration and description only and not by limitation. It is therefore contemplated that the present disclosure covers any and all modifications, variations or equivalents that fall within the spirit and scope of the basic underlying principles disclosed above and claimed herein.

What is claimed is:

1. A method for estimating aging of light emitting elements in a display panel, comprising:

determining a current, a position, and a temperature associated with a light emitting element in the display panel based on display data provided to the display panel at a time interval;

determining a current aging weight of the light emitting element based on the current and a current-aging relationship measured at a standard temperature;

determining a temperature aging weight of the light emitting element based on the temperature and a temperature-aging relationship measured at a standard current;

determining a position aging weight of the light emitting element based on the position;

determining an aging rate of the light emitting element based on the current aging weight, the temperature aging weight, and the position aging weight;

determining an aging time of the light emitting element based on the aging rate of the light emitting element and the time interval; and determining a luminance loss of the light emitting element based on the aging time and a luminance loss-aging time relationship measured at the standard temperature and the standard current.

2. The method of claim 1, wherein the light emitting element comprises an organic light emitting diode (OLED).

3. The method of claim 2, wherein the OLED is a red OLED, a green OLED, or a blue OLED; and each of the current-aging relationship, the temperature-aging relationship, and the luminance loss-aging time relationship is measured based on a red, green, or blue OLED corresponding to the OLED.

4. The method of claim 3, wherein the current-aging relationship is measured by, for each of the red, green, and blue OLEDs, measuring the OLEDs at a plurality of grayscales at a time interval, converting the grayscales into currents, and determining current aging weights of the OLEDs based on luminance losses of the OLEDs between the time interval.

5. The method of claim 3, wherein the temperature-aging relationship is measured by, for each of the red, green, and blue OLEDs, measuring the OLEDs at a plurality of temperatures at a time interval, and determining temperature aging weights of the OLEDs based on luminance losses of the OLEDs between the time interval.

6. The method of claim 3, wherein the luminance loss-aging time relationship is measured by, for each of the red, green, and blue OLEDs, measuring the OLEDs at a maximum grayscale at a time interval.

7. The method of claim 1, wherein determining the temperature associated with the light emitting element comprises:

measuring an environment temperature associated with the display panel; and calculating the temperature associated with the light emitting element based on the environment temperature, the current associated with the light emitting element, and a current-temperature factor.

8. The method of claim 1, wherein the position aging weight of the light emitting element is determined based on the position and a position-aging relationship.

9. The method of claim 1, wherein the aging time of the light emitting element is determined based on a last aging time, the aging rate of the light emitting element, and the time interval.

10. A system for estimating aging of light emitting elements in a display panel, comprising:

a display panel comprising a plurality of light emitting elements; and a control logic operatively coupled to the display panel and configured to:

determine a current, a position, and a temperature associated with one of the light emitting elements in the display panel based on display data provided to the display panel at a time interval;

determine a current aging weight of the light emitting element based on the current and a current-aging relationship measured at a standard temperature;

determine a temperature aging weight of the light emitting element based on the temperature and a temperature-aging relationship measured at a standard current;

determine a position aging weight of the light emitting element based on the position;

determine an aging rate of the light emitting element based on the current aging weight, the temperature aging weight, and the position aging weight;

determine an aging time of the light emitting element based on the aging rate of the light emitting element and the time interval; and determine a luminance loss of the light emitting element based on the aging time and a luminance loss-aging time relationship measured at the standard temperature and the standard current.

11. The system of claim 10, wherein the light emitting element comprises an organic light emitting diode (OLED).

12. The system of claim 11, wherein the OLED is a red OLED, a green OLED, or a blue OLED; and each of the current-aging relationship, the temperature-aging relationship, and the luminance loss-aging time relationship is measured based on a red, green, or blue OLED corresponding to the OLED.

13. The system of claim 12, wherein the current-aging relationship is measured by, for each of the red, green, and blue OLEDs, measuring the OLEDs at a plurality of grayscales at a time interval, converting the grayscales into currents, and determining current aging weights of the OLEDs based on luminance losses of the OLEDs between the time interval.

14. The system of claim 12, wherein the temperature-aging relationship is measured by, for each of the red, green, and blue OLEDs, measuring the OLEDs at a plurality of temperatures at a time interval, and determining temperature aging weights of the OLEDs based on luminance losses of the OLEDs between the time interval.

15. The system of claim 12, wherein the luminance loss-aging time relationship is measured by, for each of the red, green, and blue OLEDs, measuring the OLEDs at a maximum grayscale at a time interval.

16. The system of claim 10, wherein, to determine the temperature associated with the light emitting element, the control logic is further configured to:

obtain an environment temperature associated with the display panel from a temperature sensor; and calculate the temperature associated with the light emitting element based on the environment temperature, the current associated with the light emitting element, and a current-temperature factor.

17. The system of claim 10, wherein the position aging weight of the light emitting element is determined based on the position and a position-aging relationship.

18. The system of claim 10, wherein the aging time of the light emitting element is determined based on a last aging time, the aging rate of the light emitting element, and the time interval.

* * * * *